US008991012B1

(12) United States Patent
Hilbrant et al.

(10) Patent No.: US 8,991,012 B1
(45) Date of Patent: Mar. 31, 2015

(54) EXTENSION POLE ASSEMBLY WITH DUAL CONNECTING MEMBERS

(75) Inventors: Brian William Hilbrant, Alpharetta, GA (US); Anthony Sgroi, Jr., Wallingford, CT (US); David Quinlan, Plantsville, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 78 days.

(21) Appl. No.: 13/098,818

(22) Filed: May 2, 2011

Related U.S. Application Data

(60) Provisional application No. 61/329,631, filed on Apr. 30, 2010.

(51) Int. Cl.
*B25G 3/30* (2006.01)
*B25G 3/28* (2006.01)

(52) U.S. Cl.
CPC ... *B25G 3/30* (2013.01); *B25G 3/28* (2013.01)
USPC ..... 16/427; 16/422

(58) Field of Classification Search
CPC ..... B25G 3/30; B25G 3/28
USPC ..... 16/427, 429, 422; 15/143.1, 145, 176.1, 15/176.2, 176.6, 159.1; 81/177.2, 177.1, 81/177.85, 53.1–53.12; 7/167, 168; 403/3, 403/4, 180, 184, 287, 300, 301, 306, 308, 403/314, 409.1, 299
See application file for complete search history.

(56) References Cited

U.S. PATENT DOCUMENTS

| | | | | |
|---|---|---|---|---|
| 1,961,246 | A * | 6/1934 | Powers | 81/177.1 |
| 4,829,976 | A * | 5/1989 | Pourtau et al. | 16/422 |
| 5,647,591 | A * | 7/1997 | Parsons | 403/314 |
| 7,340,984 | B2 * | 3/2008 | Hsieh | 81/177.85 |
| 7,413,366 | B2 | 8/2008 | Bensussan et al. | |
| 8,006,350 | B2 * | 8/2011 | Chen | 16/422 |
| 2002/0026686 | A1 * | 3/2002 | Newman et al. | 16/427 |
| 2010/0162528 | A1 * | 7/2010 | Chen | 16/422 |
| 2010/0263133 | A1 * | 10/2010 | Langan | 7/167 |

* cited by examiner

*Primary Examiner* — Jeffrey O Brien
(74) *Attorney, Agent, or Firm* — Ohlandt, Greeley, Ruggiero & Perle, LLP

(57) ABSTRACT

An extension pole assembly having an extension pole and a pole grip is provided. The extension pole has a first and second ends, with a first connecting member at the first end and a second connecting member at the second end. The first connecting member has first implement connecting devices and the second connecting member has second implement connecting devices. At least one of the second implement connecting devices is different than at least one of the first implement connecting devices. The pole grip has a third implement connecting device that releasably mates with at least one of the first implement connecting devices and at least one of the second implement connecting devices so that the pole grip can be secured at either the first end or the second end of the extension pole.

11 Claims, 7 Drawing Sheets

EXTENSION POLE ASSEMBLY WITH DUAL CONNECTING MEMBERS

CROSS REFERENCE TO RELATED APPLICATIONS

This application claims the benefit of U.S. Provisional Application Ser. No. 61/329,631, filed Apr. 30, 2010, the contents of which are incorporated by reference herein.

BACKGROUND OF THE INVENTION

1. Field of the Invention

The present disclosure is related to extension poles. More particularly, the present disclosure is related to extension pole assemblies having an extension pole with a connecting member on each end, and a handle that can be mated at either end of the extension pole.

2. Description of Related Art

Tools and related implements (hereinafter "implements") such as, but not limited to, brooms, brushes, squeegees, and the like are well known. In order to gain access to lower areas such as floors or higher areas such as ceilings, handles or extension poles (herein after "extension poles") have been made available that connect to various implements.

Typically, a connecting member is provided to secure the implement and the extension pole to one another. One common prior art connecting member is provided by simply including a male thread on the end of the extension pole and including a corresponding female thread in the implement. In this manner, the connecting member is a threaded connecting member, where the male and female threads are removably threaded to one another.

Another common prior art connecting member is provided by including a male conical or tapered surface on the end of the extension pole and including a corresponding female conical or tapered surface in the implement. In this manner, the connecting member is formed as a press-fit connecting member where the male and female conical surfaces are press-fit to one another in a releasable fashion.

One particular prior art connecting member, which is disclosed by Applicants' own U.S. Pat. No. 7,413,366, the contents of which are incorporated herein by reference, allows for both a threaded connection and a press-fit connection between the implement and the extension pole. Thus, Applicants' own prior art connecting member allows extension poles to be connected to a wide variety of implements.

Unfortunately, the male conical surface on the connecting member only mates with a correspondingly sized female conical surface in the implement. Similarly, the male thread on the connecting member only mates with a correspondingly sized female thread in the implement. Thus, current extension poles having connecting members are limited to mating with implements having only one size female conical surfaces or thread, which limits the versatility of prior art extension poles.

Accordingly, it has been determined by the present disclosure that there is a continuing need for extension poles that overcome, alleviate, and/or mitigate one or more of the aforementioned and other deleterious effects of prior art extension poles.

BRIEF SUMMARY OF THE INVENTION

An extension pole assembly is provided that includes an extension pole and a pole grip. The extension pole includes a connecting member on each free end. Each of the connecting members includes a plurality of implement connecting devices such as, but not limited to a thread and a tapered cone, and others. Advantageously, the pole grip can be matingly received on at least one connecting device of each of the connecting members so that the pole grip can be secured at either end of the extension pole.

An extension pole assembly is provided that includes an extension pole having a first end and a second end and a pole grip. The assembly further includes a first connecting member at the first end and a second connecting member at the second end. The first connecting member has a first plurality of implement connecting devices at the first end, while the second connecting member has a second plurality of implement connecting devices at the second end. The pole grip releasably mates with at least one of the first and at least one of the second plurality of implement connecting devices. In some embodiments, the second plurality of implement connecting devices are different than the first plurality of implement connecting devices. In other embodiments, the second plurality of implement connecting devices are the same as the first plurality of implement connecting devices.

An extension pole assembly is provided that includes an extension pole having a first end and a second end and a pole grip. The assembly further includes a first connecting member having a first implement connecting device at the first end and a second connecting member having a second implement connecting device at the second end. The pole grip releasably mates with the first and second implement connecting devices so that the pole grip can be secured at either the first end or the second end of the extension pole.

An extension pole assembly is provided having an extension pole and a pole grip. The extension pole has a first end and a second end. A first connecting member is positioned at the first end, where the first connecting member has a first plurality of implement connecting devices. A second connecting member is positioned at the second end, where the second connecting member has a second plurality of implement connecting devices. At least one at least one of the second plurality of implement connecting devices is different than at least one of the first plurality of implement connecting devices. The pole grip has a third implement connecting device that releasably mates with at least one of the first plurality of implement connecting devices and at least one of the second plurality of implement connecting devices so that the pole grip can be secured at either the first end or the second end of the extension pole.

An extension pole assembly is provided with an extension pole having a first end and a second end and a pole grip that can be secured at either the first or the second end. The assembly further includes a first connecting member at the first end and a second connecting member at the second end. The first connecting member has a first threaded end and at least one other first implement connecting device, while the second connecting member has a second threaded end and at least one other second implement connecting device. The at least one other second implement connecting device is different than the at least one other first implement connecting device. The pole grip has a threaded portion that releasably mates with the first threaded end and the second threaded end.

An extension pole assembly is provided that includes an extension pole having a first end and a second end and a pole grip. The assembly further includes a first connecting member at the first end and a second connecting member at the second end. The first connecting member has a first tapered surface and a first threaded end, while the second connecting member has a second tapered surface and a second threaded end. The second tapered surface has a different angle than the first tapered surface. The pole grip has a threaded portion configured to releasably mate with the first threaded end and the second threaded end so that the pole grip can be secured at either the first end or the second end of the extension pole.

An extension pole assembly is provided that includes an extension pole having a first end and a second end and a pole grip. The assembly further includes a first connecting member at the first end and a second connecting member at the second end. The first connecting member has a first locking protrusion and at least one other first implement connecting device, while the second connecting member has a second locking protrusion and at least one other second implement connecting device. The at least one other second implement connecting device is different than the at least one other first implement connecting device. The pole grip has a locking opening that releasably mate with the first locking protrusion and the second locking protrusion so that the pole grip can be secured at either the first end or the second end of the extension pole.

The above-described and other features and advantages of the present disclosure will be appreciated and understood by those skilled in the art from the following detailed description, drawings, and appended claims.

DETAILED DESCRIPTION OF THE INVENTION

Figure 1:
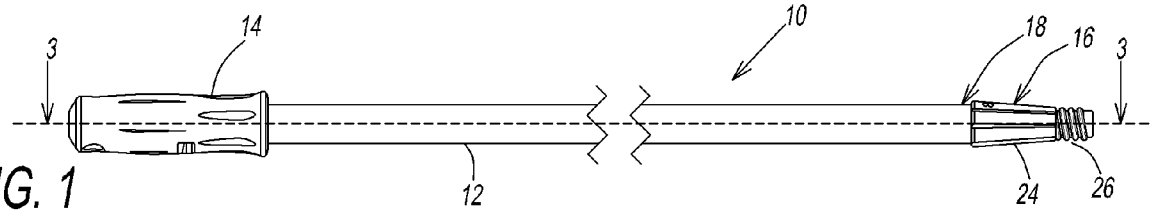
FIG. 1 is a side view of an extension pole assembly according to an exemplary embodiment of the present disclosure having a pole grip secured at a first end.
Figure 2:
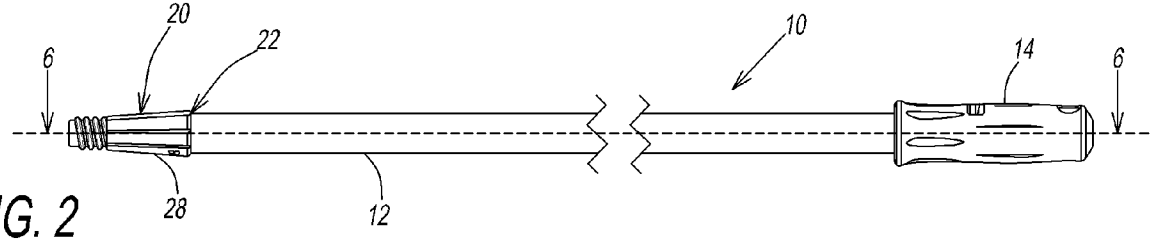
FIG. 2 is a side view of the extension pole assembly of FIG. 1 having the pole grip secured at a second end.
Figure 3:
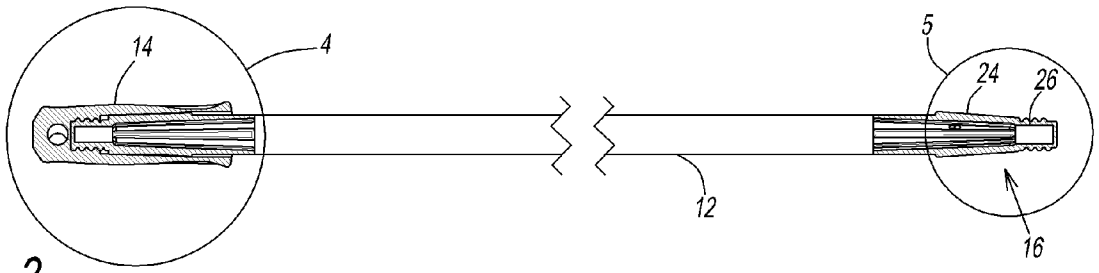
FIG. 3 is a sectional view of the extension pole assembly of FIG. 1, taken along lines 3-3 in FIG. 1.
Figure 4:
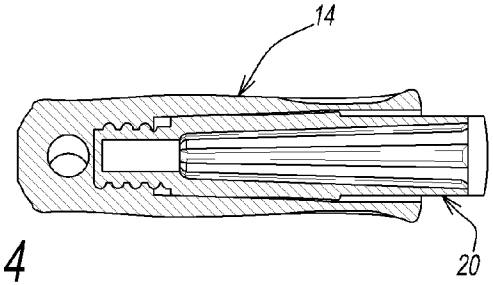
FIG. 4 is an enlarged view of a first end of the extension pole assembly of FIG. 1, taken at circle 4 in FIG. 3.
Figure 5:
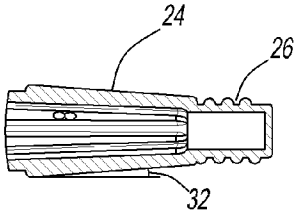
FIG. 5 is an enlarged view of a second end of the extension pole assembly of FIG. 1, taken at circle 5 in FIG. 3.
Figure 6:
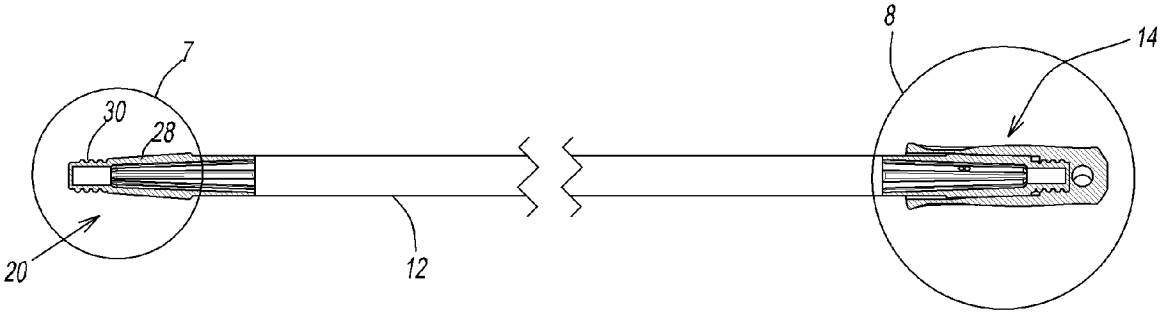
FIG. 6 is a sectional view of the extension pole assembly of FIG. 2, taken along lines 6-6 in FIG. 2.
Figure 7:
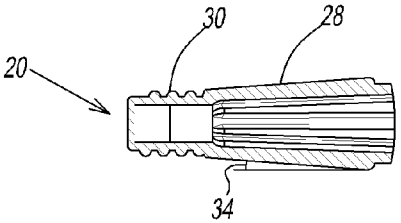
FIG. 7 is an enlarged view of the first end of the extension pole assembly of FIG. 2, taken at circle 7 in FIG. 6.
Figure 8:
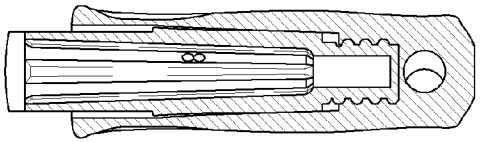
FIG. 8 is an enlarged view of a second end of the extension pole assembly of FIG. 2, taken at circle 8 in FIG. 6.

Referring to the drawings and in particular to FIGS. 1 and 2, an exemplary embodiment of an extension pole assembly is shown and is generally referred to by reference numeral 10. Assembly 10 includes an extension pole 12 and a pole grip 14. Advantageously, assembly 10 is configured so that pole grip 14 can be removably connected at either end of extension pole 12.

Extension pole 12 can have any single desired length or can have an adjustable length. Further, extension pole 12 can be made of any desired material sufficient to withstand the stresses imposed on the pole during use. For example, extension pole 12 can be made of wood, plastic, metal, carbon fiber, fiberglass, or any combinations thereof. For purposes of clarity, extension pole 12 is shown in the illustrated embodiment of the present disclosure as a single length aluminum pole.

Extension pole 12 includes a first connecting member 16 on a first end 18 and a second connecting member 20 on a second end 22. First and second connecting members 16, 20 can be permanently or releasably secured to ends 18, 22 of extension pole 12 in any desired manner. In the illustrated embodiment, first and second connecting members 16, 20 are shown forming a press-fit connection with an internal dimension of extension pole 12. However, any desired method of permanently or releasably securing first and second connecting members 16, 20 to extension pole 12 are contemplated by the present disclosure.

Both first and second connecting members 16, 20 include a plurality of implement connecting devices. For example, first connecting member 16 includes a first tapered or conical exterior surface 24 and a first threaded end 26, while second connecting member 20 includes a second tapered or conical exterior surface 28 and a second threaded end 30. Exterior surfaces 24, 28 can form a press-fit with an inner surface (not shown) of an implement in a known manner, while threaded ends 26, 30 can be threadably engaged with a corresponding thread (not shown) of an implement in a known manner.

Advantageously, assembly 10 is configured so that at least one of the implement connecting devices of connecting members 16, 20 is common to one another, while at least another of the implement connecting devices of the connecting members 16, 20 is different to one another. Pole grip 14 includes a third implement connecting device, which can be mated with at least one of the implement connecting devices of each connecting member 16, 20. In this manner, pole grip 14 can be secured at either of first or second connecting members 16, 20, which allows assembly 10 to find increased use with a larger variety of implements than previously possible by providing an increased number of implement connecting devices.

Figure 9:
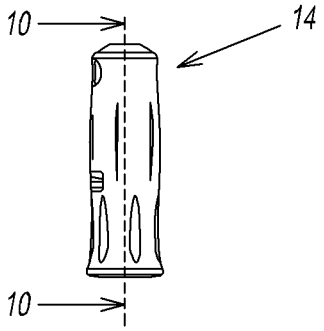
FIG. 9 is a side view of the pole grip of FIG. 1.
Figure 10:
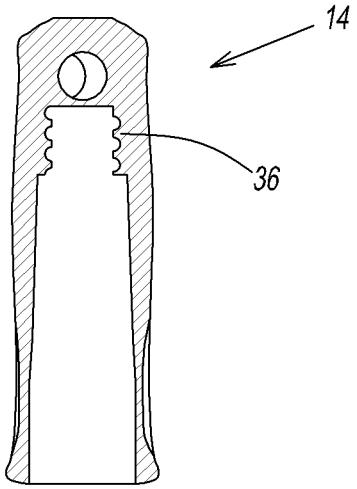
FIG. 10 is a sectional view of the pole grip of FIG. 9, taken along lines 10-10 in FIG. 9.

In the illustrated embodiment shown in FIGS. 3 through 8, connecting members 16, 20 are configured so that first and second threaded ends 26, 30 have the same thread size, while first and second exterior surfaces 24, 28 have a different cone angle 32, 34 to one another, respectively. Pole grip 14 shown in FIGS. 9 and 10 includes a threaded portion 36, which has a corresponding thread size that mates with both first and second threaded ends 26, 30.

Thus, pole grip 14 can be secured to first connecting member 16 by mating first threaded end 26 of the first connecting member to threaded portion 36 of the pole grip. Alternately, pole grip 14 can be secured to second connecting member 20 by mating second threaded end 30 of the second connecting member to threaded portion 36 of the pole grip. As such, pole grip 14 can be matingly received on either end 18, 22 of extension pole 12.

When pole grip 14 is secured to first connecting member 16, the implement connecting devices (i.e., second exterior surface 28 and second threaded end 30) of second connecting member 20 are available for use in connecting to various implements. Conversely, when pole grip 14 is secured to second connecting member 20, the implement connecting devices (i.e., first exterior surface 24 and first threaded end 26) of first connecting member 16 are available for use in connecting to various implements. In this manner, assembly 10 of the present disclosure finds increased use with a larger variety of implements than previously possible by providing an increased number of implement connecting devices.

Additionally, pole grip 14 covers at least a portion of whichever connecting member 16, 20 it is secured to, which provides the user with an easy to grip surface instead of having to grip an uncovered connecting member.

It should be recognized that assembly 10 is disclosed herein for reasons of clarity having first and second connecting members 16, 20 with only two implement connecting devices, namely tapered cones 24, 28 and threaded ends 26, 30. Of course, it is contemplated by the present disclosure for first and second connecting members 16, 20 to have any desired number of implement connecting devices.

In one preferred embodiment, first and second connecting members 16, 20 can be as shown and described in Applicants' pending U.S. application Ser. No. 13/098,732 and Applicants' issued U.S. Pat. No. 7,413,366, the contents of each of which are incorporated by reference herein in their entirety. In this embodiment, pole grip 14 includes a locking opening (not shown) instead of threaded portion 34, where the locking opening is configured to receive a locking protrusion depending from first and second connecting members 16, 20. Here, first and second connecting members 16, 20 each include three implement connecting devices, namely tapered cones 24, 28, threaded ends 26, 30, and locking protrusions with the tapered cones and threaded ends being different from one another and the locking protrusions being common to one another.

Further, it should be recognized that assembly 10 is disclosed herein with first and second connecting members 16, 20 having the same two types of implement connecting devices, namely tapered surfaces 24, 28 and threaded ends 26, 30. However, it is also contemplated by the present disclosure for first and second connecting members 16, 20 to have different types of implement connecting devices, where only one of the implement connecting devices is common to both ends.

For purposes of clarity, first and second threaded ends 26, 30 are described hereinabove as having the "same thread size", while threaded portion 36 is described hereinabove as having a "corresponding thread size" that mates with both the first and second threaded ends. However, it is contemplated by the present disclosure for threaded portion 36 of pole grip 14 to have two interleaved threads within the threaded portion. Here, one of the interleaved threads can mate with first threaded end 26, while the other of the interleaved threads can mate with second threaded end 30. Thus, first and second threaded ends 26, 30 are considered by the present disclosure to be in common with one another when both of the threaded ends can be threadably secured to single threaded portion 36 of pole grip 14.

Additionally, it is contemplated by the present disclosure for all of the connecting devices on first connecting member 16 to be different than all of the connecting devices on second connecting member 20 provided that the connecting device on pole grip 14 can connect with at least one of the connecting devices of the first connecting member and at least one of the connecting devices of the second connecting member.

Additionally, it is contemplated by the present disclosure for all of the connecting devices on first connecting member 16 to be the same as all of the connecting devices on second connecting member 20 provided that the connecting device on pole grip 14 can connect with at least one of the connecting devices of the first connecting member and at least one of the connecting devices of the second connecting member. In this embodiment, assembly 10 provides a longer life product in the event of damage to threads, the cone, or the locking member occurs.

Figure 11:
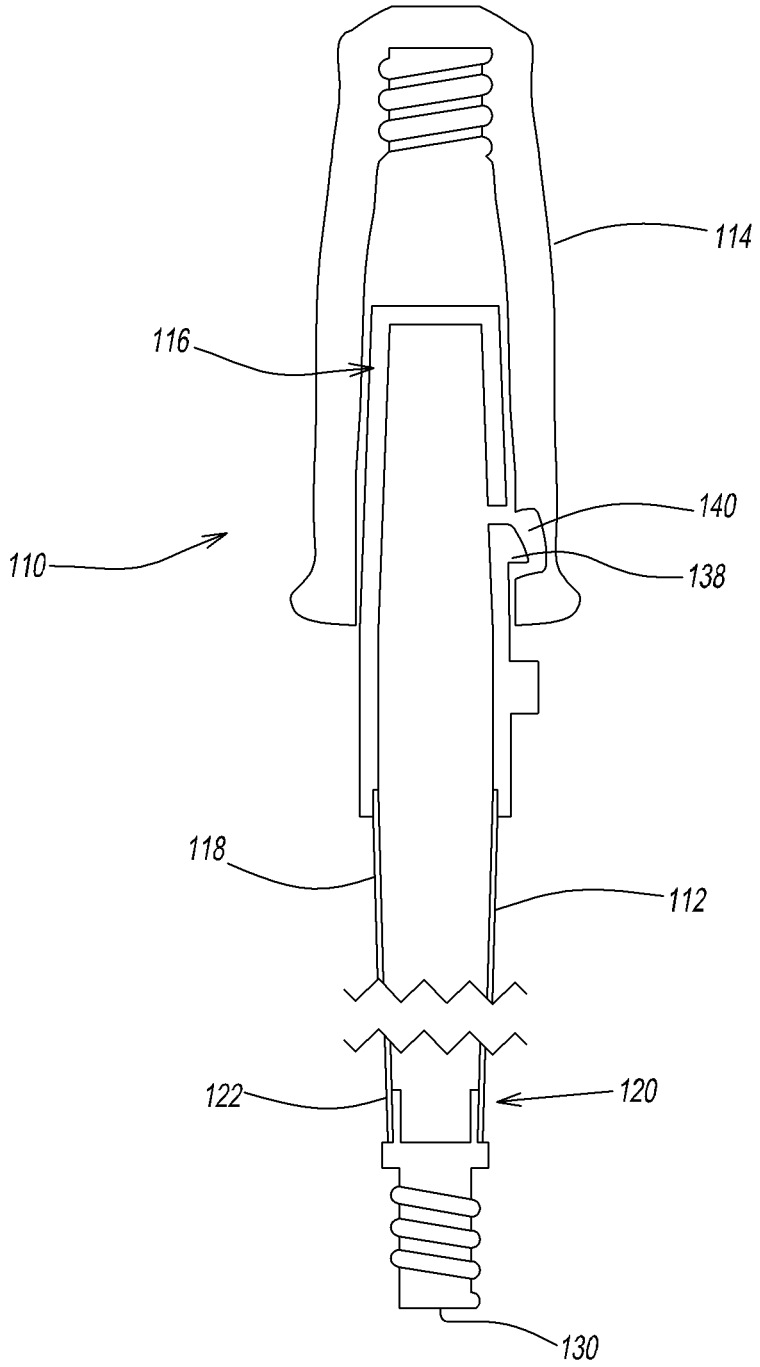
FIG. 11 is a sectional view of an extension pole assembly according to another exemplary embodiment of the present disclosure having a pole grip secured at a first end.
Figure 12:
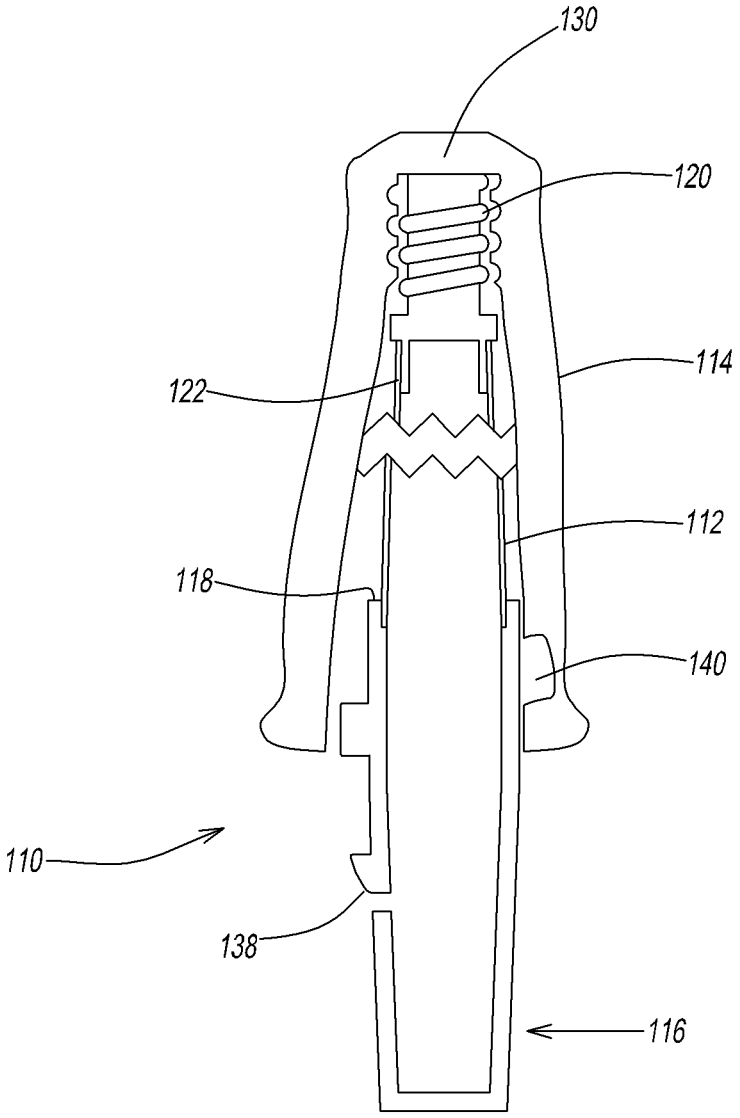
FIG. 12 is a sectional view of the extension pole assembly of FIG. 11 having the pole grip secured at a second end.

Referring now to FIGS. 11 and 12, a second exemplary embodiment of an extension pole assembly according to the present disclosure is shown and is generally referred to by reference numeral 110. Here, component parts having similar or analogous functions are labeled in multiples of one hundred.

Assembly 110 includes an extension pole 112 and a pole grip 114, where pole grip 114 can be removably connected at either end of extension pole 112.

Extension pole 112 includes a first connecting member 116 on a first end 118 and a second connecting member 120 on a second end 122. First and second connecting members 116, 120 can be permanently or releasably secured to ends 118, 122 of extension pole 112 in any desired manner. In the illustrated embodiment, first and second connecting members 116, 120 are shown forming a press-fit connection with an internal dimension of extension pole 112. However, any desired method of permanently or releasably securing first and second connecting members 116, 120 to extension pole 112 are contemplated by the present disclosure.

Both first and second connecting members 116, 120 include a single implement connecting device. For example, first connecting member 116 includes a locking protrusion 138, while second connecting member 120 includes a threaded end 130. Locking protrusion 138 can form a locking connection with a locking opening (not shown) of an implement in a known manner, while threaded end 130 can be threadably engaged with a corresponding thread (not shown) of an implement in a known manner.

Advantageously, assembly 110 is configured so that the single implement connecting device of each of connecting members 116, 120 can be mated with pole grip 114. Here, pole grip 114 includes a threaded portion 136, which has a corresponding thread size that mates with threaded end 130 and a locking opening 140 that mates with locking protrusion 138.

When pole grip 114 is secured to first connecting member 116, the implement connecting device (i.e., threaded end 130) of second connecting member 120 is available for use in connecting to various implements. Conversely, when pole grip 114 is secured to second connecting member 120, the implement connecting device (i.e., locking protrusion 138) of first connecting member 116 is available for use in connecting to various implements. In this manner, assembly 110 of the present disclosure finds increased use with a larger variety of implements than previously possible by providing an increased number of implement connecting devices.

Additionally, pole grip 114 covers at least a portion of whichever connecting member 116, 120 it is secured to, which provides the user with an easy to grip surface instead of having to grip an uncovered connecting member.

It should be recognized that assemblies 10, 110 have been described above by way of example only as having pole grip 14, 114 connected to connecting members 16, 20, 116, 120, respectively by way of the connecting devices themselves. However, it is contemplated by the present disclosure for pole grip 14, 114 and connecting members 16, 20, 116, 120 to include a set of complimentary connectors for connecting the pole grip to the connecting member above and beyond the connecting devices provided for securing implements to the extension pole.

Figure 13:
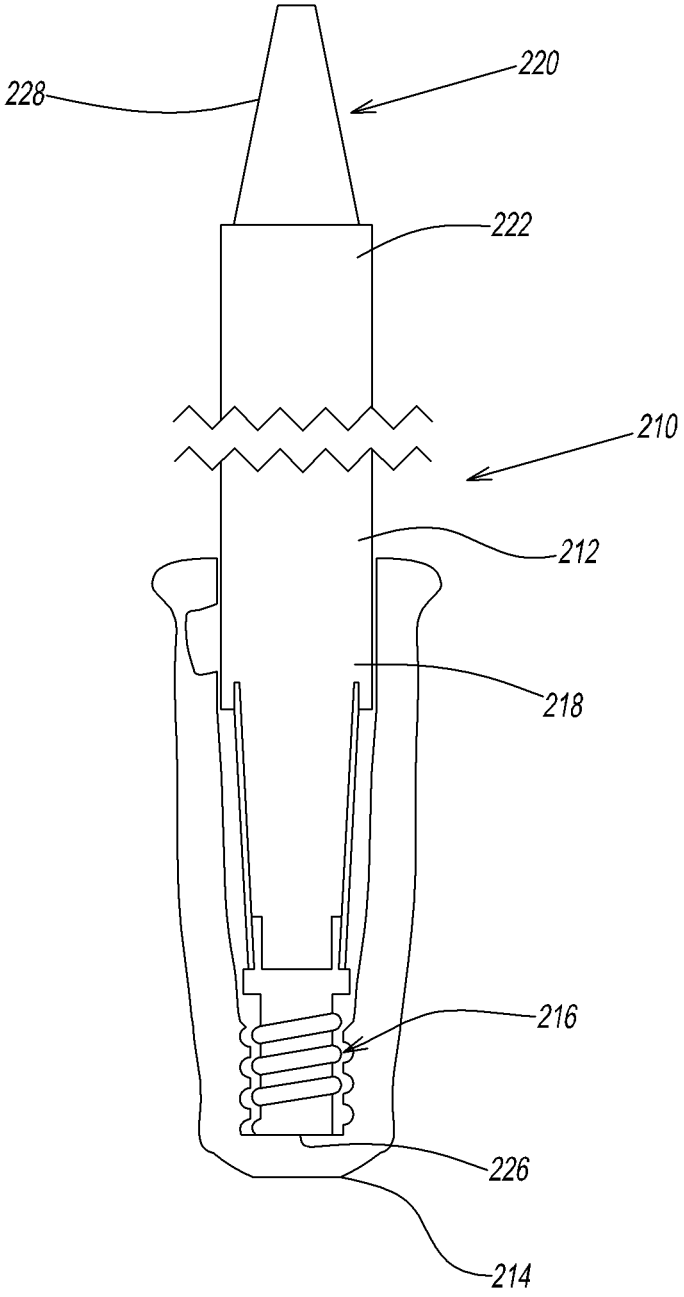
FIG. 13 is a sectional view of an extension pole assembly according to another exemplary embodiment of the present disclosure having a pole grip secured at a first end.
Figure 14:
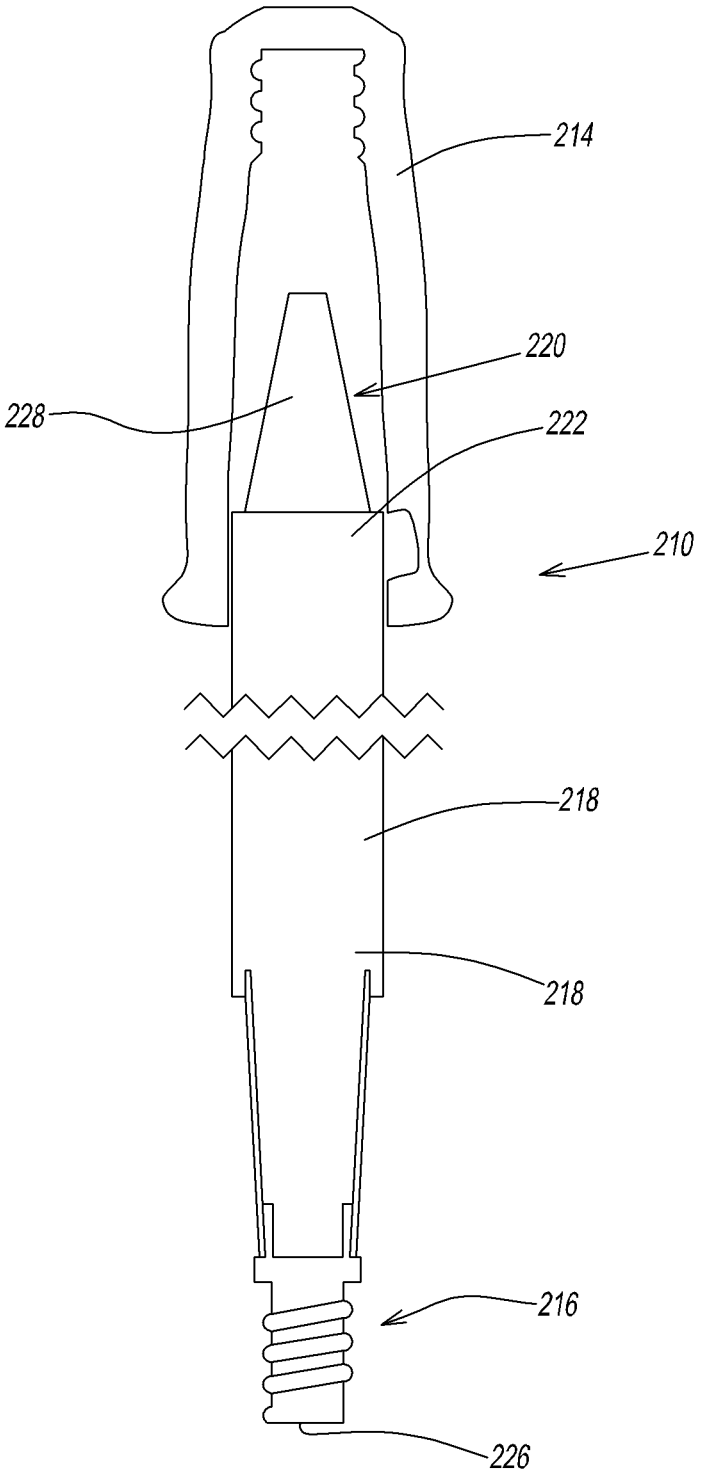
FIG. 14 is a sectional view of the extension pole assembly of FIG. 13 having the pole grip secured at a second end.

Referring now to FIGS. 13 and 14, a third exemplary embodiment of an extension pole assembly according to the present disclosure is shown and is generally referred to by reference numeral 210. Here, component parts having similar or analogous functions are labeled in multiples of two hundred.

Assembly 210 includes an extension pole 212 and a pole grip 214, where pole grip 214 can be removably connected at either end of extension pole 212.

Extension pole 212 includes a first connecting member 216 on a first end 218 and a second connecting member 220 on a second end 222. First and second connecting members 216, 220 can be permanently or releasably secured to ends 218, 222 of extension pole 212 in any desired manner. In the illustrated embodiment, first and second connecting members 216, 220 are shown forming a press-fit connection with an internal dimension of extension pole 212. However, any desired method of permanently or releasably securing first and second connecting members 216, 220 to extension pole 212 are contemplated by the present disclosure.

Both first and second connecting members 216, 220 include a single implement connecting device. For example, first connecting member 216 includes a threaded end 226, while second connecting member 220 includes a tapered or conical exterior surface 228. Threaded end 226 can be threadably engaged with a corresponding thread (not shown) of an implement in a known manner, while exterior surface 228 can form a press-fit with an inner surface (not shown) of an implement in a known manner.

Advantageously, assembly 210 is configured so that pole grip 214 can be mated directly with first and second ends 218, 222 of extension pole 212. In the illustrated embodiment, pole grip 214 forms a press-fit directly to first and second ends 218, 222 of extension pole 212.

When pole grip 214 is secured to first end 218 as shown in FIG. 13, the implement connecting device (i.e., tapered surface 228) of second connecting member 220 is available for use in connecting to various implements. Conversely, when pole grip 214 is secured to second end 222 as shown in FIG. 14, the implement connecting device (i.e., threaded end 226) of first connecting member 216 is available for use in connecting to various implements. In this manner, assembly 210 of the present disclosure finds increased use with a larger variety of implements than previously possible by providing an increased number of implement connecting devices.

Additionally, pole grip 214 covers whichever connecting member 216, 220 it is secured over, which provides the user with an easy to grip surface instead of having to grip an uncovered connecting member.

It should be recognized that assembly 210 has been described above by way of example only as having pole grip 214 connected directly to first and second ends 218, 222, respectively by a press-fit connection to extension pole 212. However, it is contemplated by the present disclosure for pole grip 214 and ends 218, 222 to include a set of complimentary connectors for connecting the pole grip to extension pole 212.

It should also be recognized that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. An extension pole assembly comprising:

a pole having a first end and a second end;

a first connecting member at said first end, said first connecting member having a first threaded end and at least one other first implement connecting device;

a second connecting member at said second end, said second connecting member having a second threaded end and at least one other second implement connecting device, said at least one other second implement connecting device being different than said at least one other first implement connecting device; and a pole grip having a threaded portion configured to releasably mate with said first threaded end and said second threaded end so that said pole grip can be secured at either said first end or said second end of said pole, wherein said at least one other first implement connecting device is a first tapered cone having a first angle and said at least one other second implement connecting device is a second tapered cone having a second angle, and wherein said first and second angles are different.

2. The extension pole assembly as in claim 1, wherein said pole has a single desired length or an adjustable length.

3. The extension pole assembly as in claim 1, wherein said pole is made of wood, plastic, metal, carbon fiber, fiberglass, or any combinations thereof.

4. The extension pole assembly as in claim 1, wherein said at least one other first implement connecting device comprises more than two implement connecting devices.

5. The extension pole assembly as in claim 1, wherein said at least one other second implement connecting device comprises more than two implement connecting devices.

6. The extension pole assembly as in claim 1, wherein said threaded portion comprises a first interleaved thread that mates with said first threaded end and a second interleaved thread that mates with said second threaded end.

7. The extension pole assembly as in claim 1, wherein said threaded portion comprises a single thread that mates with both said first and second threaded ends.

8. An extension pole assembly comprising:

a pole having a first end and a second end;

a first connecting member at said first end, said first connecting member having a first threaded end and a first tapered surface;

a second connecting member at said second end, said second connecting member having a second threaded end and a second tapered surface, said second tapered surface having a different angle than said first tapered surface; and a pole grip having a threaded portion configured to releasably mate with said first threaded end and said second threaded end so that said pole grip can be secured at either said first end or said second end of said pole.

9. An extension pole assembly comprising:

a pole having a first end and a second end;

a first connecting member at said first end, said first connecting member having a first threaded end and a first tapered cone having a first angle;

a second connecting member at said second end, said second connecting member having a second threaded end and a second tapered cone having a second angle, said first angle being different from and said second angle; and a pole grip having a threaded portion configured to releasably mate with said first threaded end and said second threaded end so that said pole grip can be secured at either said first end or said second end of said pole.

10. The extension pole assembly as in claim 9, wherein said pole has a single desired length or an adjustable length.

11. The extension pole assembly as in claim 9, wherein said pole is made of wood, plastic, metal, carbon fiber, fiberglass, or any combinations thereof.

* * * * *